US006989766B2

(12) United States Patent
Mese et al.

(10) Patent No.: US 6,989,766 B2
(45) Date of Patent: Jan. 24, 2006

(54) SMART TRAFFIC SIGNAL SYSTEM

(75) Inventors: John Carl Mese, Cary, NC (US); Nathan J. Peterson, Raleigh, NC (US); Rod David Waltermann, Rougemount, NC (US); Arnold S. Weksler, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 203 days.

(21) Appl. No.: 10/745,260

(22) Filed: Dec. 23, 2003

(65) Prior Publication Data

US 2005/0134478 A1 Jun. 23, 2005

(51) Int. Cl.
*G08G 1/095* (2006.01)

(52) U.S. Cl. ..... 340/907; 701/118

(58) Field of Classification Search ..... 340/905
See application file for complete search history.

(56) References Cited

U.S. PATENT DOCUMENTS

| | | | | |
|---|---|---|---|---|
| 3,188,927 | A * | 6/1965 | Woods | 404/9 |
| 3,750,099 | A * | 7/1973 | Proctor | 340/932 |
| 3,872,423 | A * | 3/1975 | Yeakley | 340/932 |
| 5,134,393 | A * | 7/1992 | Henson | 340/933 |
| 5,539,398 | A | 7/1996 | Hall et al. | 340/907 |
| 5,673,039 | A * | 9/1997 | Pietzsch et al. | 340/905 |
| 5,926,113 | A | 7/1999 | Jones et al. | 340/906 |
| 6,243,026 | B1 | 6/2001 | Jones et al. | 340/906 |
| 6,246,954 | B1 | 6/2001 | Berstis et al. | 701/117 |
| 6,385,531 | B2 | 5/2002 | Bates et al. | 701/117 |
| 2002/0008637 | A1 | 1/2002 | Lemelson et al. | 340/907 |
| 2003/0016143 | A1 | 1/2003 | Ghazarian | 340/901 |

* cited by examiner

*Primary Examiner*—Jeffery Hofsass
*Assistant Examiner*—George A Bugg
(74) *Attorney, Agent, or Firm*—Jeanine S. Ray-Yarletts

(57) ABSTRACT

Traffic signal data is broadcast, for receipt by vehicles traversing the roadways controlled by the traffic signals. If desired, traffic lights are provided with the capability to broadcast their location, status, changing cycles and timing data continuously. A receiving system in a vehicle is configured to receive the traffic signal data and display, to a user of the vehicle, visual display information and/or audible information informing the user of a speed range which, if followed, optimizes the use of the highway and minimizes the number of starts and stops that must be made.

18 Claims, 7 Drawing Sheets

SMART TRAFFIC SIGNAL SYSTEM

BACKGROUND OF THE INVENTION

1. Field of the Invention

This invention relates to traffic control systems and, more particularly, to a "smart" system that broadcasts traffic signal status to vehicle-based receivers.

2. Description of the Related Art

Automobiles are a part of everyday life in urban and suburban communities. Traffic lights dot the landscape in urban centers and the surrounding communities, and control the flow of traffic on roads, large and small. Drivers must pay attention to traffic signals and failure to heed them results in increased traffic congestion and accidents.

While traffic controls are a necessary part of any road and highway system, measures are taken to try to keep the traffic flow on the major arteries moving as much as possible. It is well known, for example, to "time" lights along a stretch of highway so that vehicles progressing along the highway at the legal speed limit will encounter a reduced number of red lights causing them to have to stop.

Timing of lights operates adequately as long as people are going the speed limit and the traffic is not impeding their progress. However, it is fairly common for users of highways and roads to exceed the speed limit without considering the timing of the lights; in fact, most drivers may be unaware of the timing of the lights and not realize that obeying the speed limit will smooth their progression along the road. Thus, urged on by the fast pace of everyday life, many will find themselves stopping and starting along the highway, since their high speeds negate the benefit of the timing of the lights.

In addition to being dangerous, this type of driving wastes fuel and results in unnecessary wear on brakes and other vehicle components used during the braking and acceleration process. Accordingly, it would be desirable to have a method and system which would prompt drivers to maintain speeds that minimize the amount of acceleration and stopping that they need to do, and encourage compliance with speed limits.

SUMMARY OF THE INVENTION

In accordance with the present invention, traffic signal data is broadcast, for receipt by vehicles traversing the roadways controlled by the traffic signals. In a preferred embodiment, traffic lights are provided with the capability to broadcast their location, status, changing cycles and timing data continuously. A receiving system in a vehicle is configured to receive the traffic signal data and display, to a user of the vehicle, visual display information and/or audible information informing the user of a speed range which, if followed, optimizes the use of the highway and minimizes the number of starts and stops that must be made.

In a representative embodiment, the present invention comprises a method of disseminating, to a vehicle, traffic signal information regarding a traffic signal, comprising the steps of: broadcasting traffic signal data identifying present and future traffic signal sequences for the traffic signal; receiving the traffic signal data by the vehicle; calculating, based on the received traffic signal data, a speed range to be followed by the vehicle to minimize the amount of stopping, starting, and/or speed changing required while enabling the vehicle to progress past the traffic signal; and displaying the calculated speed range to occupants of the vehicle.

DETAILED DESCRIPTION OF THE PREFERRED EMBODIMENTS

Figure 1:
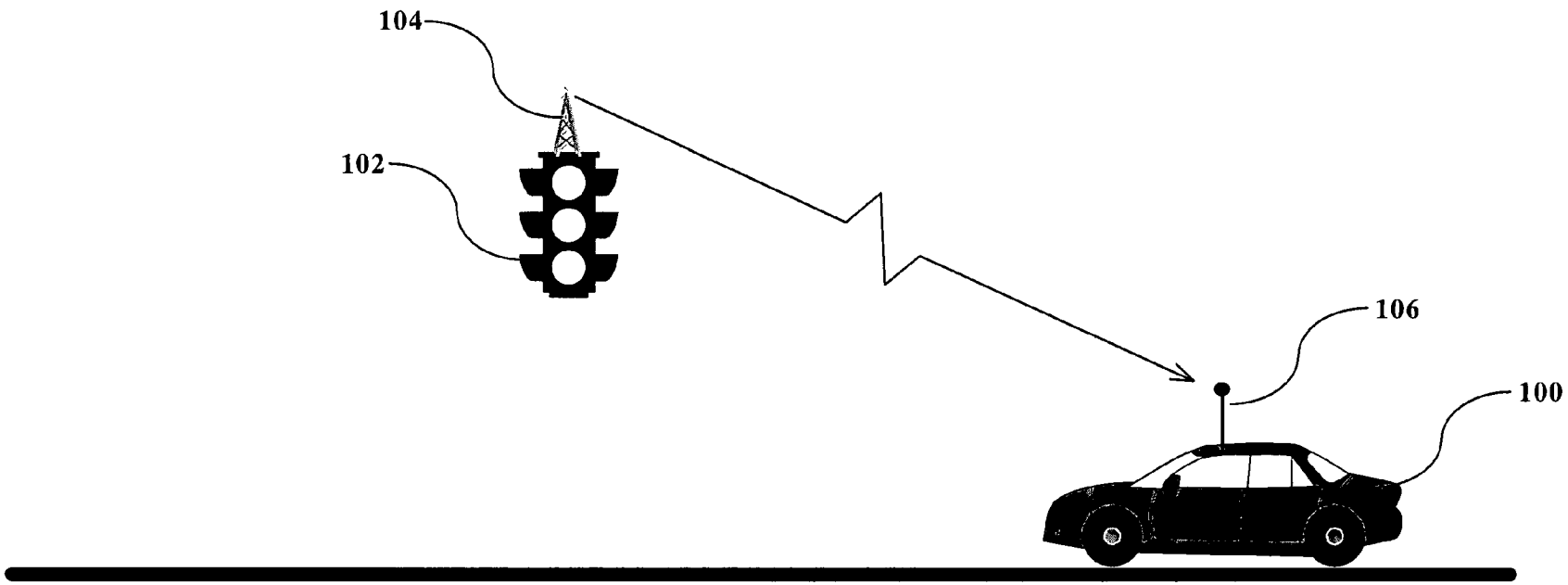
FIG. 1 illustrates the general architecture of the present invention.

FIG. 1 illustrates the general architecture of a preferred embodiment of the present invention. As shown in FIG. 1, a vehicle 100 approaches a traffic signal 102. Traffic signal 102 is equipped with a transmitter 104. Transmitter 104 broadcasts, on a regular basis, traffic signal data identifying its location (e.g., by broadcasting, for example, GPS coordinates associated with its location). In addition, traffic signal 102 transmits traffic signal data identifying present and future traffic signal sequences, e.g., current information regarding the status of the light (red, greed, or yellow), timing data related to its cycle, and any schedule information regarding future cycles (e.g., if at a particular time of day, the timing of the signal cycle changes due to changing traffic conditions, this information is also transmitted). Although the described embodiment illustrates a transmitter associated with each traffic signal, it is understood that data pertaining to multiple traffic signals, e.g., all traffic signals in a particular region or controlling a particular roadway, could be gathered in a central location using standard telemetry-gathering techniques, and then broadcast regionally from a centralized, independent transmission source. In such an alternative embodiment, the traffic signals, being connected via wires to central locations for power and control purposes, could use a wired or a wireless network to forward the traffic signal data to the centralized transmission source, such as a collecting server. The information transmitted may also include directional components associating the data elements with the light orientation, i.e., the cycle data for vehicles approaching the signal in the north-south direction will be identifiably different from the cycle data for vehicles approaching the signal in the east-west direction. Further, the transmitted information may also include data related to right and left turn arrows, blinking lights, or any other light status information pertaining to the transmitting light.

Vehicle 100 is equipped with a receiver 106, illustrated representatively by an antenna on vehicle 100 in FIG. 1. The onboard receiver 106 of vehicle 100 captures the broadcast traffic signal data from traffic signals (or independent transmission sources) within its vicinity. A traffic-signal processor is integrated into, or coupled to, receiver 106 and receives the captured traffic signal data and, together with vehicle information (e.g., current vehicle speed, vehicle location, etc.) obtained from an onboard GPS system and/or a vehicle system processor associated with the vehicle, calculates an optimal pace to facilitate traffic flow. For example, by receiving the traffic light transmission data and calculating the distance to the light and the speed limit for the road on which the vehicle is traveling, the driver and/or passengers of vehicle 100 can have displayed to them information identifying the optimal speed range to allow the driver to successfully pass through the upcoming traffic light or lights without having to significantly slow down or stop. If conditions are such that the driver cannot make the light and still maintain a legal speed (maximum or minimum), then the display can go blank, or display an indication advising the user of this fact.

Figure 2:
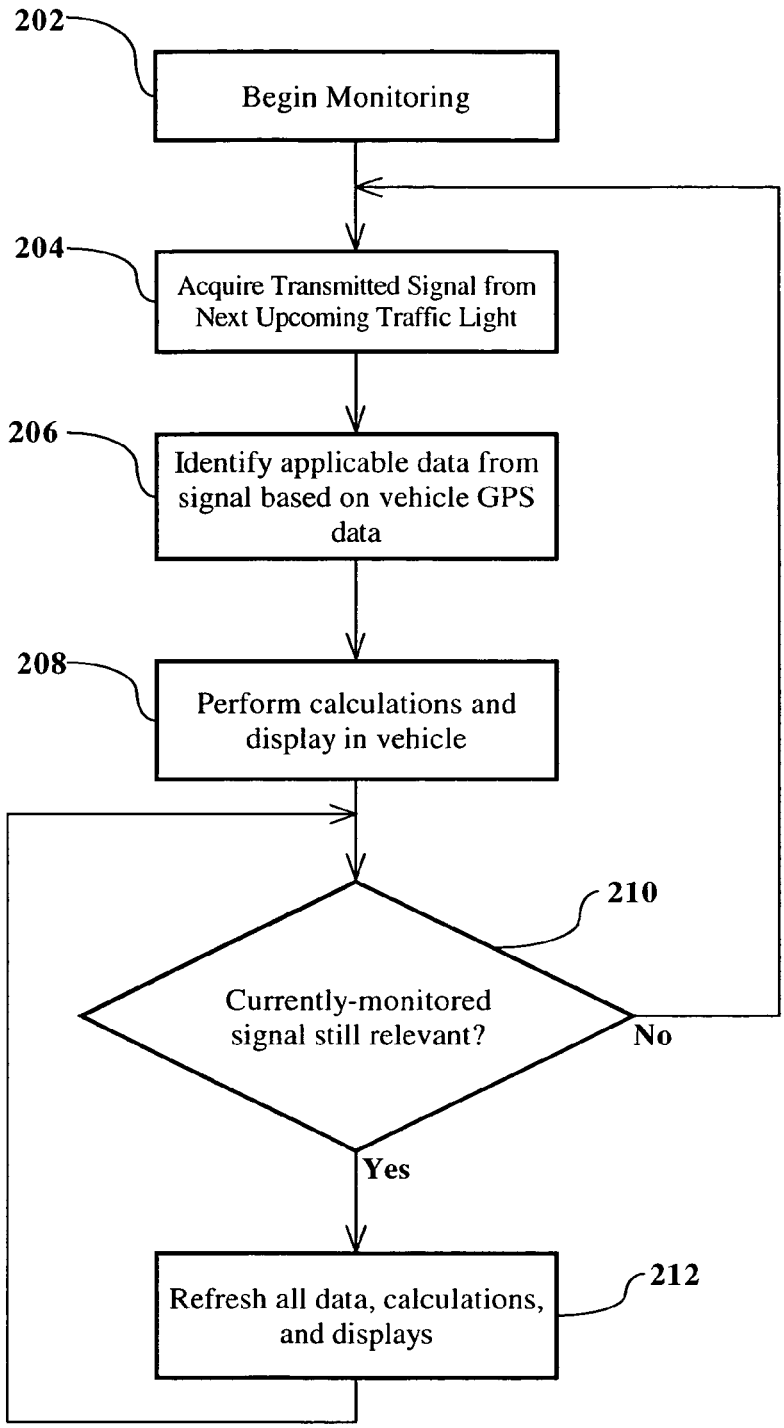
FIG. 2 is a flowchart illustrating the operation of the present invention.

FIG. 2 is a flowchart illustrating the operation of the present invention. At step 202, the monitoring process commences. This would typically coincide with the ignition of the vehicle being turned on, thereby activating the receiving device; however, it could also be turned on by the user "on demand".

At step 204, the receiver in the vehicle acquires the transmitted signal from the next upcoming traffic light. In actuality, the receiver will acquire transmitted data from any traffic lights within range, including the next upcoming traffic light. To identify which of the data to use for performing the vehicle speed information, etc., at step 206, the applicable data (i.e., data associated with the next upcoming light) is identified, based upon vehicle GPS information and the location information for the transmitting lights.

The vehicle GPS information includes the vehicle location, the vehicle direction-of-travel, the speed of travel, and can even be as fine-grained as which lane on which particular roadway the vehicle is moving. Based upon this information, the processor of the present invention will "filter out" all but the data related to the next upcoming traffic signal. The vehicle GPS information is obtained from a standard vehicle GPS system commonly factory installed, or installed as an after-market item, in vehicles today. Some or all of the information can also be acquired via on-board vehicle processors that are routinely used to, for example, display the vehicle speed to the driver on a dashboard display; the information from the vehicle processor can also be output to the traffic system processor for use in performing the calculations described herein.

At step 208, the appropriate calculations are performed by the traffic system processor. This will include, for example, the amount of time that will pass before the upcoming light will change from red to green (or green to red, etc.) and the speed range that the vehicle should maintain to pass the upcoming light without needing to stop. The traffic signal, preferably, also transmits speed limit information for the road on which the vehicle is traveling.

At step 210, a determination is made as to whether or not the currently monitored signal is still relevant. If the vehicle is still approaching the traffic light, then the information is still relevant and of interest to the passenger or driver of the vehicle. Once the vehicle passes the traffic signal, the information becomes irrelevant and is not of interest anymore; instead, it is preferable that the receiver begin to pick up signals from the next upcoming traffic signal. Since the vehicle GPS data identifies where the vehicle is located relative to the transmitting traffic signals, it is a simple matter to determine the relevancy of any of the transmitting traffic signals to the vehicle at any given moment, i.e., by calculating distances and selecting the shortest one, taking into consideration the direction of travel and the road being traversed. Accordingly, if, at step 210, it is determined that the currently monitored signal is no longer relevant, then the process proceeds back to step 204 to acquire the transmitted signal from the next upcoming traffic light and the process proceeds as described above. If, on the other hand, it is determined at step 210 that the currently monitored signal is still relevant, then at step 212, steps are taken to refresh all data, calculations, and displays. This means that the signal continues to be monitored from the traffic light and the appropriate data continues to be identified and used to perform calculations for display in the vehicle. The process then proceeds back to step 210 to again determine if the currently monitored signal is still relevant.

Using the process described above, a passenger or driver of a vehicle containing a receiver configured in accordance with the present invention will continually monitor upcoming traffic signals and be given indications as to the most efficient means of proceeding.

Figure 3:
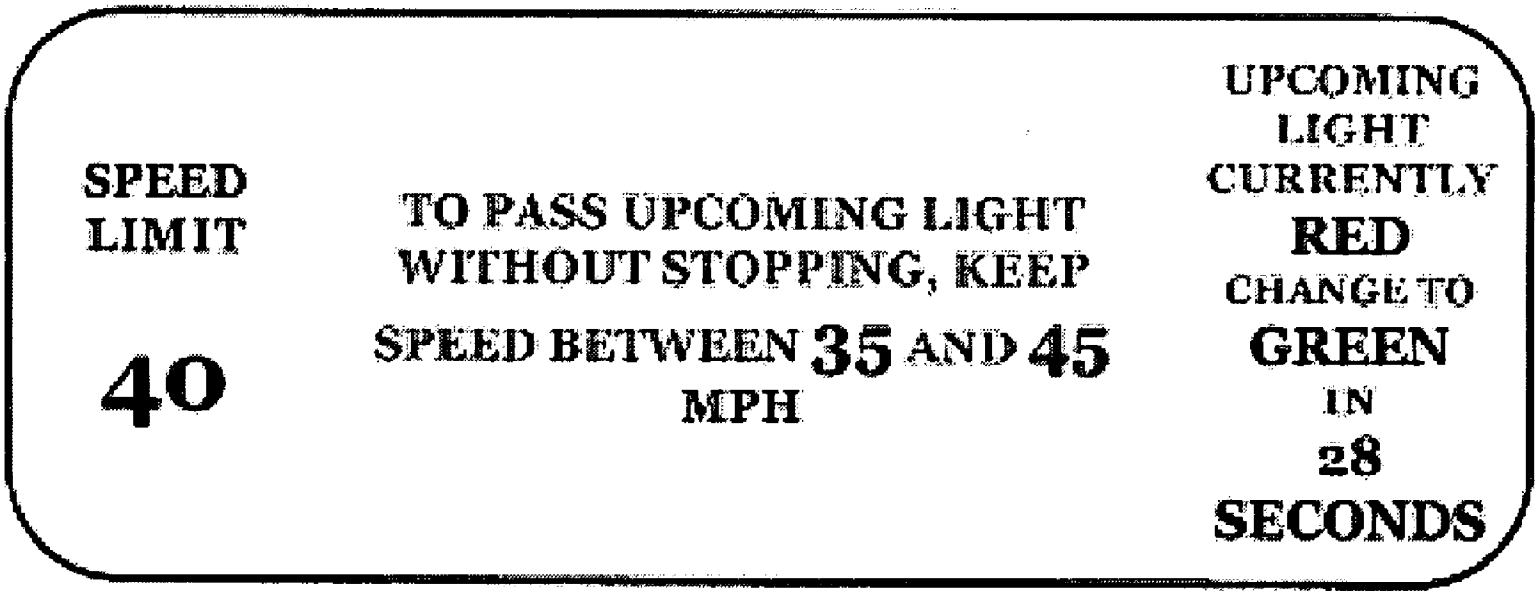
FIG. 3 illustrates an example of a display that is displayed in the vehicle.

FIG. 3 illustrates an example of a display that is displayed in the vehicle. As can be seen from FIG. 3, on the left side of a display, the speed limit on the road on which the vehicle is traveling is displayed. In the center, information regarding the appropriate speed range required to pass the upcoming light without stopping is identified. On the far right, a "countdown clock" provides the driver or passenger with information regarding the status of the upcoming light and when it is expected to change. This third category of information can be useful, for example, in a situation where a driver is stopped at a traffic light and wishes to get out of the vehicle to check a tire or clear the windshield, etc. Using this third display in FIG. 3, the user will know how much time is left before the light will change and thus know if there is sufficient time to leave the vehicle and perform the desired task. It is understood that FIG. 3 is just a representative example illustrating a possible configuration for a display in accordance with the present invention. Numerous other configurations for displaying any information derivable from the traffic light data and vehicle data will be apparent and are considered to be part of this disclosure.

Figure 4A:
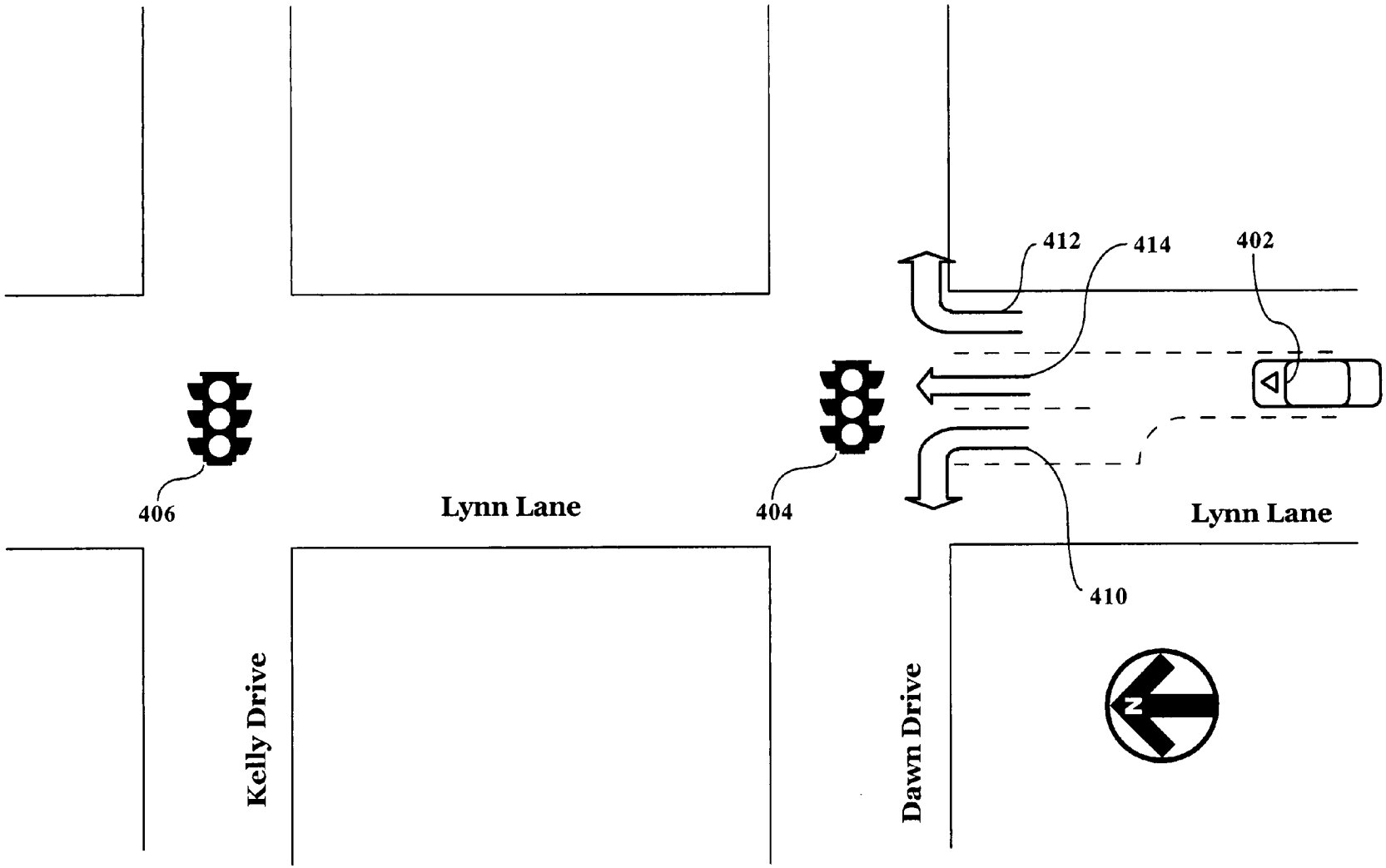
FIG. 4*a* illustrates an example of the overall operation of the present invention.

FIG. 4*a* illustrates an example of the overall operation of the present invention. In this example, a vehicle 402 is traveling northbound on Lynn Lane approaching the intersection of Lynn Lane with Dawn Drive, as shown. Beyond Dawn Drive, Lynn Lane intersects Kelly Drive. At each intersection, a traffic light controls the flow of traffic. Specifically, at the intersection of Lynn Lane and Dawn Drive, traffic light 404 controls traffic, and at the intersection of Lynn Lane and Kelly Drive, traffic light 406 controls the flow of traffic.

Vehicle 402 is one-quarter mile from the traffic light traveling at 60 miles per hour. The minimum speed along this road is 40 mile per hour and the maximum speed is 65 miles per hour. Drivers approaching traffic light 404 in the northbound lane of Lynn Lane have the option of turning left from left-turn lane 410, right from right-turn lane 412, or proceeding through the intersection in lane 414. Traffic light 404 has a left turn signal, a right turn signal and a regular, red-yellow-green light for controlling traffic proceeding through the intersection. Both traffic lights 404 and 406 are configured in accordance with the present invention to transmit signal data to vehicles within range of their transmitter, e.g., within five miles. The present invention is not limited to this range and it is understood that the transmitters can transmit as far as desired, depending upon the needs of the operator of the traffic control system.

Each traffic light has a unique code that it transmits identifying itself, and separately identifies data by the direction of traffic flow that is being controlled. For example, traffic light 404 transmits a first set of data with an identifier indicating it pertains to signals information for northbound traffic; a second set of data with an identifier indicating it pertains to signal information for eastbound traffic; a third set of data with an identifier indicating it pertains to signal information for southbound traffic; and a fourth set of data with an identifier indicating it pertains to signal information for westbound traffic. Any unique identifiers can be used as long as they identify the various signals, directions, and, if desired, lanes to which the data being transmitted applies (e.g., the data identified as being signal information for northbound traffic can be further specified, by use of appropriate identifiers, as being data for the left lane, center lane, or right lane). For identifying the traffic light itself, GPS coordinates or any other method can be used, as long as unique identifiers are transmitted associated with the appropriate data and can be "decoded" by receiving devices in vehicles.

Figure 4B:
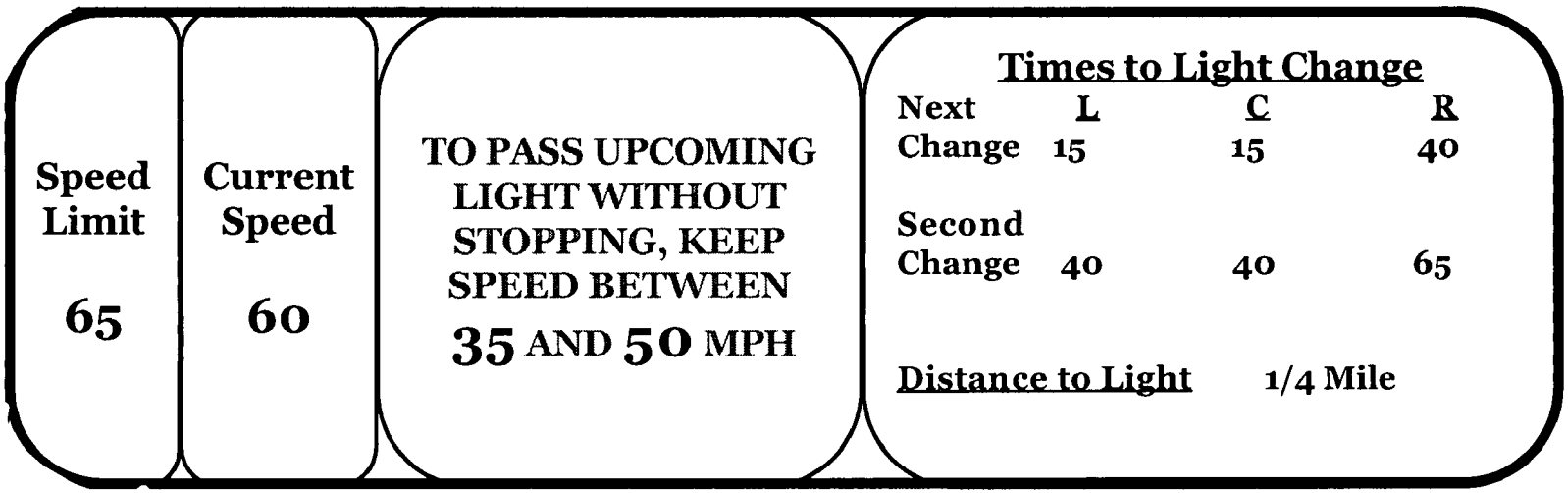
FIG. 4*b* illustrates the display device in a vehicle displaying information.

As described above, vehicle 402 may be receiving light cycle information from several traffic signals at once, including, in this example, from both lights 404 and 406. However, since vehicle 402 is equipped with a GPS device, the vehicle location, direction of travel, and speed is known or can be calculated, and this vehicle information, combined with the transmitted information from the lights that has been received by the vehicle's receiving device, allows the filtering out of all transmitted data except for the data from the nearest light that the vehicle is approaching. Thus, in this example, traveling in the center lane and approaching light 404, vehicle 402 will receive, at minimum, data pertaining to the standard red-yellow-green light (for the northbound center lane), and potentially the data for northbound left-turn and right-turn signals as well. The display device in vehicle 402 could then, for example, display the information shown in FIG. 4*b*. As can be seen in FIG. 4*b*, vehicle 402 can tell that the red left-turn signal and red center lane signal will change to green in 15 seconds, and the green right-turn signal will change to its next sequence (e.g., a yellow right-turn arrow, a steady green, etc.) in 40 seconds. Further, the user also knows that the left-turn signal will change again in 40 seconds, the center lane light will change again in 40 seconds, and the green right-turn arrow will change again in 65 seconds. Finally, the user is told that by traveling between 35 and 50 miles per hour, in any of the lanes, the driver will "make" the light. In addition, the user is also given the information that they are ¼-mile from the traffic light and currently traveling at 60 miles per hour. It is understood that any desired information can be displayed (e.g., the street names of the intersection being approached) as long as the data required to display the information is available.

It is understood that in some situations, drivers utilize pre-programmed routes in connection with GPS devices, such that driving directions are given to the user as they proceed along a road. If the user has pre-programmed such a driving itinerary, and the user has set a plan that would cause him or her to turn left onto Dawn Drive off of Lynn Lane, then if desired, the system could be configured to only display the data for the left-turn lane of Lynn Lane as the driver approaches light 404.

For safety, the system can be configured, if desired, to always provide a "buffer" for the vehicle so that if the driver follows the suggested speeds, they will never be entering the intersection precisely at the time of a light change, thereby reducing the chance that they will impact a driver starting prematurely in the intersecting road.

The above-described steps can be implemented using standard well-known programming techniques. The novelty of the above-described embodiment lies not in the specific programming techniques but in the use of the steps described to achieve the described results. Software programming code which embodies the present invention is typically stored in permanent storage of some type, such as permanent storage of a receiving device and/or transmitting device described herein. In a client/server environment, such software programming code may be stored with storage associated with a server. The software programming code may be embodied on any of a variety of known media for use with a data processing system, such as a diskette, or hard drive, or CD-ROM. The code may be distributed on such media, or may be distributed to users from the memory or storage of one computer system over a network of some type to other computer systems for use by users of such other systems. The techniques and methods for embodying software program code on physical media and/or distributing software code via networks are well known and will not be further discussed herein.

It will be understood that each element of the illustrations, and combinations of elements in the illustrations, can be implemented by general and/or special purpose hardware-based systems that perform the specified functions or steps, or by combinations of general and/or special-purpose hardware and computer instructions.

These program instructions may be provided to a processor to produce a machine, such that the instructions that execute on the processor create means for implementing the functions specified in the illustrations. The computer program instructions may be executed by a processor to cause a series of operational steps to be performed by the processor to produce a computer-implemented process such that the instructions that execute on the processor provide steps for implementing the functions specified in the illustrations. Accordingly, the appended figures support combinations of means for performing the specified functions, combinations of steps for performing the specified functions, and program instruction means for performing the specified functions.

Figure 5:
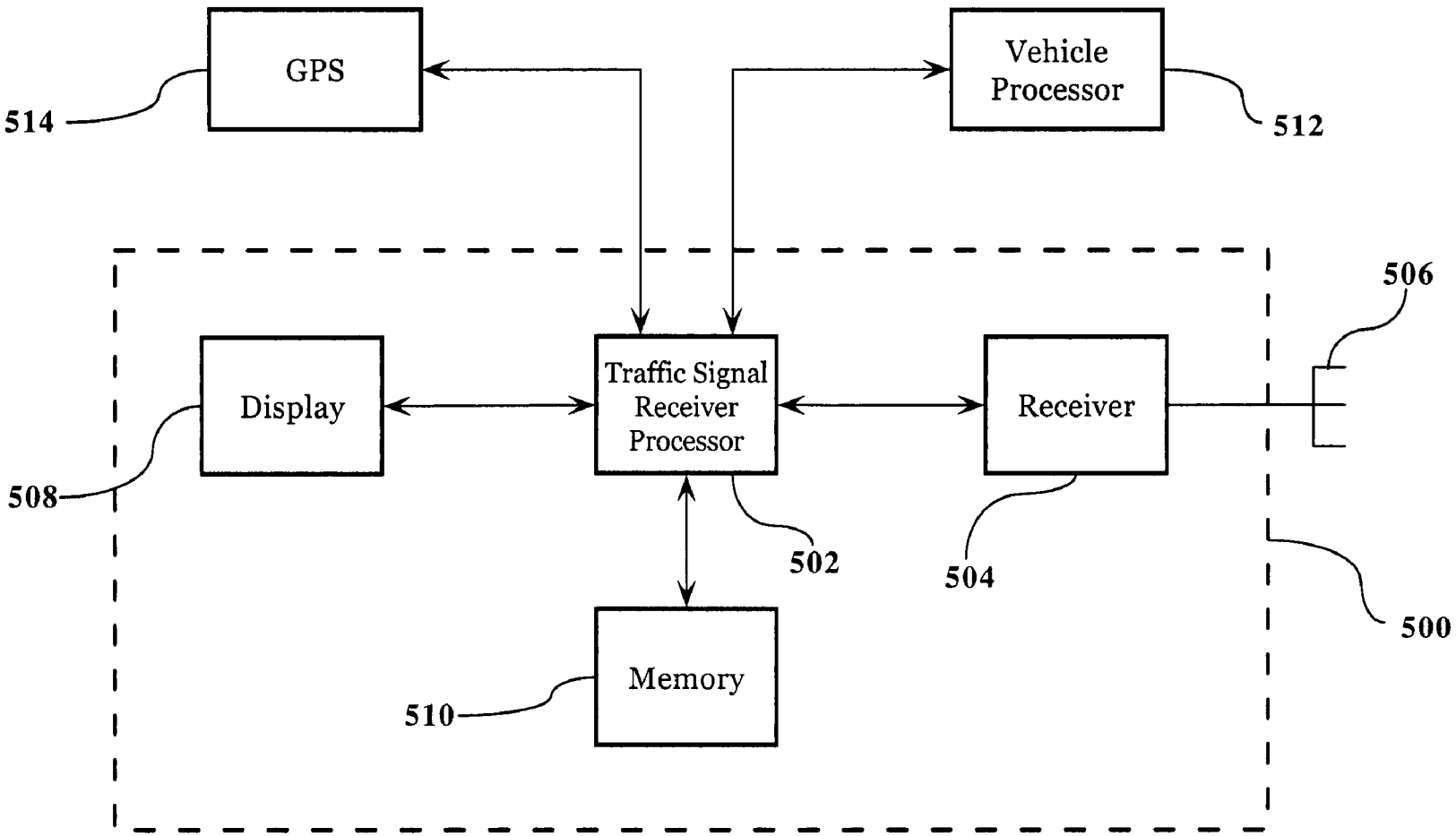
FIG. 5 is a block diagram of a receiver 500 in accordance with the present invention.

FIG. 5 is a block diagram of a receiver 500 in accordance with the present invention. Referring to FIG. 5, a traffic signal receiver processor 502 is coupled to a receiver 504, which is coupled to a receiving antenna 506. A display 508 and memory 510 are also coupled to traffic signal processor 502. A vehicle processor 512 and GPS 514 are coupled to receiver 500 as well.

Traffic signal receiver processor 502 can comprise any known processing device and in a preferred embodiment comprises a computer processor or other processing means that can be powered by a vehicle power source, traditionally a 12 volt system. Most vehicles contain processors today and it is understood that an existing processing device of a vehicle can be programmed to perform the processing functions of traffic signal receiver processor 502.

Receiver 504 and antenna 506 can comprise any known receiving means that is capable of wirelessly receiving data signals and forwarding the received data signals to a processing device such as traffic signal receiver processor 502. Display 508 can comprise any known display device, e.g., LED displays, LCD displays, CRT's and the like. Memory 510 is for storing programming information and received data, as well as any other data that might be used by traffic signal receiver processor 502. Any known memory device that can perform these functions can be used for memory 510.

Vehicle processor 512 and GPS 514 are shown as separate components with respect to receiver 500; however, it is understood that each of these devices can be integrated as part of receiver 500 and still fall within the scope of the present invention. Vehicle processor 512 comprises, for example, any processor that is installed in a vehicle to gather, store, and display data relevant to the operation of the vehicle in which it is installed. For example, vehicle processor can comprise an on-board processing device that gathers data from vehicle systems and calculates and displays vehicle speed, direction of travel, engine temperature, and other standard parameters.

GPS 514 comprises a standard GPS system found in vehicles today, which includes sensing hardware and software enabling position information regarding the vehicle in which it is installed to be determined. It may also include processing hardware and software enabling the display, within the vehicle cabin, of a map showing the vehicle and its relationship to landmarks on the map, and allow the plotting of itineraries and the display (both visually and audibly, of travel directions form point to point, all in a well known manner. Both the vehicle processor 512 and GPS 514, if not integrated into the receiver 500, must provide access to data output form each device so that it can be used by the traffic signal receiver processor 502.

Figure 6:
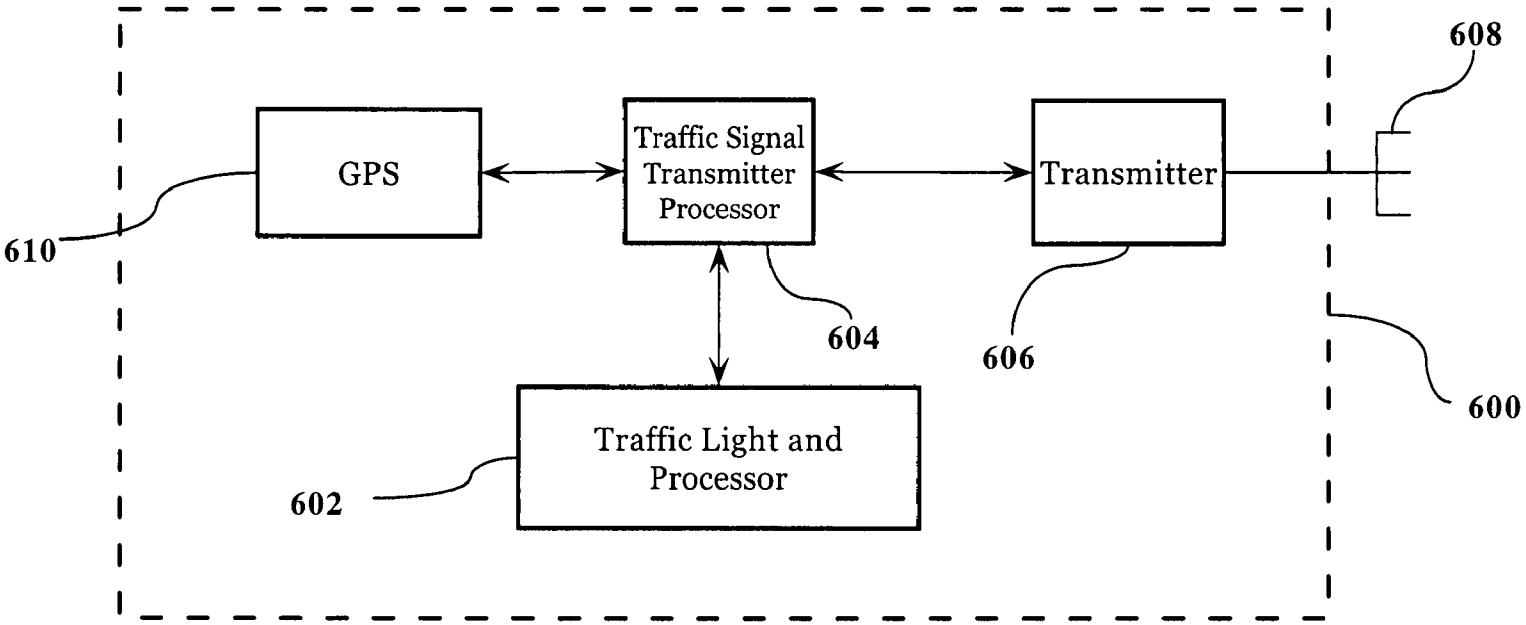
FIG. 6 is a block diagram illustrating a traffic light 600 in accordance with the present invention.

FIG. 6 is a block diagram illustrating a traffic light 600 in accordance with the present invention. A traffic light and processor 602 comprises any standard traffic signal device having on board or remote control capability. The traffic light and processor 602 must include output means (terminals, wireless outputs, or any other means of outputting data) enabling the various states, cycles, and other operational information to be output to a traffic signal transmitter processor 604. Traffic signal transmitter processor 604 can comprise any processing device capable of receiving data and configured to store, identify, perform calculations on, or otherwise process the data in accordance with the present invention. A computer or other known processing means will suffice for performance of these functions.

GPS 610 is coupled to traffic signal transmitter processor 604 and is configured to supply location data to traffic signal transmitter processor 604 so that the location of the traffic light in which it is installed can be determined and transmitted. Transmitter 606 and transmission antenna 608 are coupled to traffic signal transmitter processor 604 and are configured to receive data from traffic signal transmitter processor 604 and transmit the data in a well known manner. The transmitter 606 must be compatible with receiver 508 of FIG. 5, so that the two devices are capable of communicating information from the traffic signal 600 to the receiver 500. Any known method of transmission, e.g, radio frequency (RF) transmission, will function for the transmit/receive functions of the present invention.

While there has been described herein the principles of the invention, it is to be understood by those skilled in the art that this description is made only by way of example and not as a limitation to the scope of the invention. Accordingly, it is intended by the appended claims, to cover all modifications of the invention which fall within the true spirit and scope of the invention.

Although the present invention has been described with respect to a specific preferred embodiment thereof, various changes and modifications may be suggested to one skilled in the art and it is intended that the present invention encompass such changes and modifications as fall within the scope of the appended claims.

We claim:

1. A method comprising:

broadcasting traffic signal data identifying present and future traffic signal sequences for a traffic signal;

receiving said traffic signal data at a vehicle;

calculating, based on said received traffic signal data, a speed range to be followed by said vehicle to minimize the amount of stopping, starting, and/or speed changing required while enabling the vehicle to progress past the traffic signal; and displaying said calculated speed range to the occupants of said vehicle;

wherein said traffic signal data includes a location of said traffic signal and directional components identifying the directions of approach to said traffic signal to which said data pertains;

and wherein said calculating step determines a location, speed of travel, and direction of travel of said vehicle;

identifying the location of said traffic signal relative to said vehicle;

identifying the appropriate directional component of said traffic signal data to be used, based on said vehicle's direction of approach to said traffic signal; and calculating said speed range based on said location, speed of travel, and direction of travel of said vehicle, and the location of said traffic signal relative to said vehicle.

2. The method of claim 1, wherein said vehicle location and direction of travel is determined via a global positioning system calculation.

3. The method of claim 2, wherein said speed of travel is determined via a speed sensor of the vehicle.

4. The method of claim 3, wherein the speed range displayed in said vehicle corresponds to the particular lane of the roadway on which said vehicle is traveling.

5. The method of claim 1, wherein said traffic signal data is broadcast from said traffic signal.

6. The method of claim 1, wherein said traffic signal data is delivered by said traffic signal via a wired network or a wireless network to a collecting server which gathers said traffic signal data from all traffic signals within a predetermined area and wherein said collecting server broadcasts said traffic signal data.

7. A system comprising:

a transmitter broadcasting traffic signal data identifying present and future traffic signal sequences for a traffic signal;

a receiver receiving said traffic signal data at a vehicle;

a processor calculating, based on said received traffic signal data, a speed range to be followed by said vehicle to minimize the amount of stopping, starting, and/or speed changing required while enabling the vehicle to progress past the traffic signal; and a display device displaying said calculated speed range to the occupants of said vehicle;

wherein said traffic signal data includes a location of said traffic signal and directional components identifying the directions of approach to said traffic signal to which said data pertains;

and wherein said processor includes means for determining a location, speed of travel, and direction of travel of said vehicle;

means for identifying the location of said traffic signal relative to said vehicle;

means for identifying the appropriate directional component of said traffic signal data to be used, based on said vehicle's direction of approach to said traffic signal; and means for calculating said speed range based on said location, speed of travel, and direction of travel of said vehicle, and the location of said traffic signal relative to said vehicle.

8. The system of claim 7, wherein said vehicle location and direction of travel is determined via a global positioning system calculation.

9. The system of claim 8, wherein said speed of travel is determined via a speed sensor of the vehicle.

10. The system of claim 9, wherein the speed range displayed in said vehicle corresponds to the particular lane of the roadway on which said vehicle is traveling.

11. The system of claim 7, wherein said transmitter is coupled to said traffic signal and broadcasts said traffic signal data directly from said traffic signal.

12. The system of claim 7 further comprising a collecting server configured to receive said traffic signal data via a wired network or a wireless network from all traffic signals within a predetermined area, said collecting server being further configured to broadcast said traffic signal data.

13. A computer program product comprising a computer readable storage medium having a computer readable program code embodied in the medium, the computer readable program code comprising instructions effective when executing to:

broadcast traffic signal data identifying present and future traffic signal sequences for a traffic signal;

receive said traffic signal data at a vehicle;

calculate, based on said received traffic signal data, a speed range to be followed by said vehicle to minimize the amount of stopping, starting, and/or speed changing required while enabling the vehicle to progress past the traffic signal; and display said calculated speed range to the occupants of said vehicle;

wherein said traffic signal data includes a location of said traffic signal and directional components identifying the directions of approach to said traffic signal to which said data pertains;

and wherein said computer readable program code for calculating comprises instructions effective when executing to:

determine a location, speed of travel, and direction of travel of said vehicle;

identify the location of said traffic signal relative to said vehicle;

select the appropriate directional component of said traffic signal data to be used, based on said vehicle's direction of approach to said traffic signal; and calculate said speed range based on said location, speed of travel, and direction of travel of said vehicle, and the location of said traffic signal relative to said vehicle.

14. The computer program product of claim 13, wherein said vehicle location and direction of travel is determined via a global positioning system calculation.

15. The computer program product of claim 14, wherein said speed of travel is determined via a speed sensor of each vehicle.

16. The computer program product of claim 15, wherein the speed range displayed in said vehicle corresponds to the particular lane of the roadway on which said vehicle is traveling.

17. The computer program product of claim 13, wherein said computer readable program code for broadcasting traffic signal data comprises instructions effective when executing to:

broadcast said traffic signal data directly from said traffic signal.

18. The computer program product of claim 13, wherein said computer readable program code further comprises instructions effective when executing to:

receive said traffic signal data at a collecting server via a wired network or a wireless network from all traffic signals within a predetermined area, and wherein said computer readable program code for broadcasting traffic signal data comprises instructions effective when executing to:

broadcast said traffic signal data from said collecting server.

* * * * *